US011332342B2

(12) United States Patent
Pokkinen et al.

(10) Patent No.: US 11,332,342 B2
(45) Date of Patent: May 17, 2022

(54) ELEVATOR

(71) Applicant: Kone Corporation, Helsinki (FI)

(72) Inventors: Olli Pokkinen, Helsinki (FI); Arto Nakari, Helsinki (FI)

(73) Assignee: Kone Corporation, Helsinki (FI)

( * ) Notice: Subject to any disclaimer, the term of this patent is extended or adjusted under 35 U.S.C. 154(b) by 613 days.

(21) Appl. No.: 16/255,108

(22) Filed: Jan. 23, 2019

(65) Prior Publication Data

US 2019/0248626 A1 Aug. 15, 2019

(30) Foreign Application Priority Data

Feb. 13, 2018 (EP) ..... 18156442

(51) Int. Cl.
*B66B 5/02* (2006.01)
*B66B 1/30* (2006.01)

(52) U.S. Cl.
CPC ..... *B66B 5/027* (2013.01); *B66B 1/30* (2013.01)

(58) Field of Classification Search
CPC .. B66B 5/027; B66B 1/30; B66B 5/02; B66B 5/06; B66B 1/308
See application file for complete search history.

(56) References Cited

U.S. PATENT DOCUMENTS 6,425,461 B1 * 7/2002 Wang ..... B66B 5/027 187/290
2010/0044160 A1 * 2/2010 Agirman ..... B66B 5/027 187/290
2011/0120810 A1 5/2011 Schroeder-Brumloop et al.
2011/0290593 A1 * 12/2011 Kauppinen ..... B66B 1/30 187/290
2012/0286738 A1 * 11/2012 Rosmann ..... H02J 9/061 320/134
2015/0136531 A1 * 5/2015 Rogers ..... B66B 5/027 187/290
2018/0229968 A1 * 8/2018 Cheng ..... H02M 7/537
2018/0327215 A1 * 11/2018 Kattainen ..... G05B 9/02
2019/0248626 A1 * 8/2019 Pokkinen ..... B66B 1/30

FOREIGN PATENT DOCUMENTS

EP 3228572 A1 10/2017
JP 2003020171 A 1/2003
JP 2010208764 A 9/2010
JP 5743345 B2 7/2015

OTHER PUBLICATIONS

CA European Search Report Application Patent No. 18156442.8 dated Jul. 30, 2018.

* cited by examiner

*Primary Examiner* — Marlon T Fletcher
(74) *Attorney, Agent, or Firm* — Harness, Dickey & Pierce, P.L.C.

(57) ABSTRACT

The invention relates to an elevator comprising an elevator motor and an elevator drive comprising a backup power supply and an emergency drive module to enable release of trapped passengers in case of a power fault, based on the energy of the backup power supply, whereby the elevator drive comprises a drive housing and the backup power supply is located in a separate backup module which is releasably supported in a mounting position at the drive housing of the elevator drive, which backup module comprises an insulated backup module housing and an electric interface which connects to a complementary interface of the elevator drive located at the drive housing.

18 Claims, 2 Drawing Sheets

ELEVATOR

Figure 1:
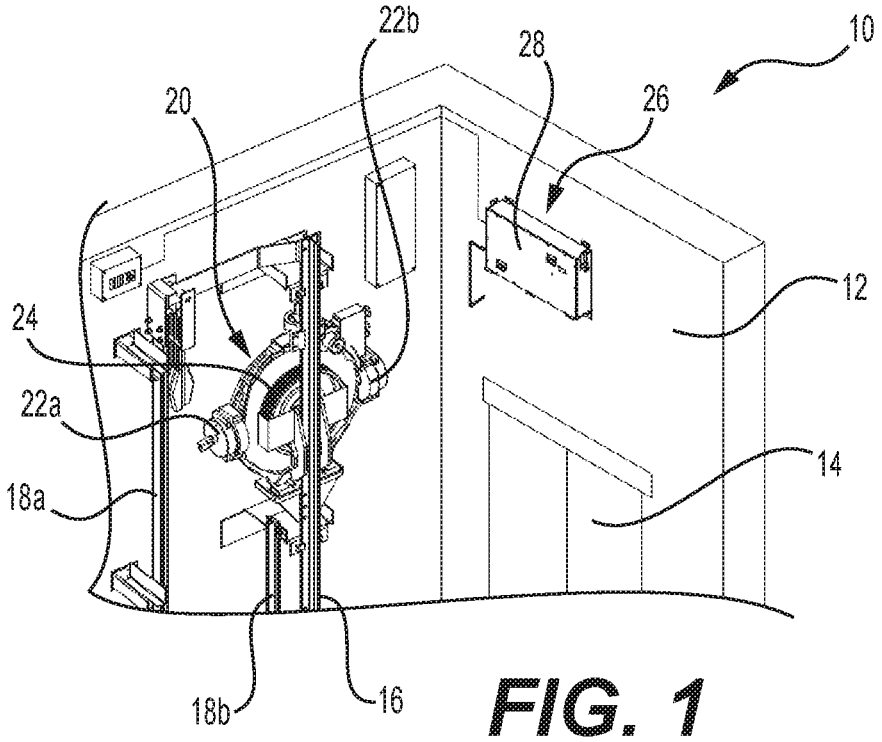

This application claims priority to European Patent Application No. EP18156442.8 filed on Feb. 13, 2018, the entire contents of which are incorporated herein by reference.

The present invention relates to an elevator comprising an elevator motor and an elevator drive comprising a backup power supply and an emergency drive module to enable release of trapped passengers in case of a power fault. The power for the emergency drive module is obtained from the backup power supply. The elevator drive comprises a drive housing and the backup power supply is located in a separate backup module.

It is object of the invention to provide an elevator with the option of a manual and/or automatic emergency operation at low costs.

The object is solved with an elevator according to claim 1. Preferred embodiments of the invention are subject matter of the dependent claims. Advantageous embodiments of the invention are also disclosed in the description and drawings.

According to the invention, the separate backup module is releasably supported in a mounting position at the drive housing of the elevator drive. The backup module comprises an insulated backup module housing and an electric interface which connects to a complementary interface located at the drive housing. According to the invention, the mechanical effort for the connection of the backup power supply to the elevator drive is minimized by this plug-connection.

Furthermore, by plugging the backup module in an accommodation area of the drive housing all the relevant components regarding the elevator drive, including the backup power supply are integrated so that the costs for production and maintenance are reduced. The backup module can be detached from the drive housing very easily, preferably with a snap-lock connection, so that preferably no tools are necessary to change the backup module. Thus, replacement or maintenance of the backup module is easily possible. Preferably, the backup module housing or/and the drive housing are embodied as plastic housings which isolate all the electric components from being accessible. By this means, the operation reliability is improved and the danger of electric shock is essentially reduced. In plastic housings preferably a metal jacket is located inside the plastic housing to improve the EMC (electromagnetic compatibility).

The drive housing could preferably also be an aluminum housing. This improves EMC compared to a plastic housing. An aluminum housing could be used preferably both for the backup module and the drive. Preferably the aluminum housing could be isolated to avoid danger of electric shocks. However, this is not necessary as the battery cells/supercapacitors can be set far enough from the backup module housing or they might have internal/own isolations. The above mentioned plastic or aluminum housings can be used both for the drive housing as wells as for the backup module.

Preferably, the backup module housing is accommodated in a recess, preferably in an edge of the drive housing. By this means, the backup module housing and the backup module housing may form an aligned outer surface which is insensitive against mechanical impact and dirt. In case the recess is located in an edge of the drive housing, the backup module has two outer surfaces which are extending in a 90°-angle (in case of a typical rectangular drive housing). Thus, the backup module can be easily handled when being mounted or detached from the drive housing. This geometry further allows an easy guide for the backup module during plugging and an easy snap-lock connection. Further, generally the concept of the backup module being integrated in the drive housing avoids any separate additional housings with a corresponding interface wiring between the elevator drive and the backup module.

Preferably, the outer surfaces of the backup module housing are aligned with the corresponding surfaces of the drive housing in the mounting position. By this means, the danger of damaging the backup module is reduced as there are no edges protruding from the surface of the drive housing. Further the whole arrangement is insensitive against dirt.

Preferably, the electrical interface of the backup module and the complementary interface of the elevator drive are located in areas of the drive housing and backup module housing which do not form outer surfaces after the backup module is mounted in the drive housing. Via this measure, the electric contactors between the elevator drive and the backup module are covered by the drive housing and the backup module housing when the backup module is mounted or plugged into the accommodation recess of the drive housing. This again reduces the danger of electric shock to maintenance persons and on the other hand improves the operational liability of the whole elevator.

In a preferred embodiment of the invention, the electrical interface and the complementary interface of the drive housing are each covered by movable isolations. These movable isolations guarantee that the electric contacts of the electric interface and complementary interface are covered even when the backup module is not plugged in its mounting position in the drive housing so that the danger of electric shock of maintenance technicians is essentially reduced.

Preferably, in this case, the movable isolations are movable by at least one protrusion in the vicinity of the electric interface or complementary interface of the respective other housing or by the electric contacts of the electric interface or complementary interface themselves. That means, the electric contacts and/or protrusion of one component (backup module, elevator drive) moves away the movable isolations of the other component, respectively. This means that any movable isolations are automatically removed when the backup module is plugged into the drive housing, so that the electric connection between the electric contacts of the electric interface and of the complementary interface is enabled.

Preferably, the elevator drive comprises a charging circuit for the backup power supply so that all relevant components regarding the emergency operation of the elevator are integrated with the elevator drive. This reduces production as also maintenance costs.

Preferably, the backup power supply comprises a battery, a supercapacitor or a combination of per se known power storing components.

In a preferred embodiment of the invention, the drive housing and the module housing comprise complementary guides which are configured to define a linear movement of the module housing with respect to the drive housing, which movement is limited by stop faces, which enable a reliable connection of the electric interface with the complementary interface. Thus, the guide surfaces guide the backup module into a correct electric connection with the drive when being plugged into the drive housing. This again improves the operation reliability of the whole arrangement and leads to a longer lifetime of the electric contacts of the electric interface and the complementary interface.

Preferably, the drive housing is installed in the elevator shaft in the vicinity of an elevator landing door or access opening. This enables the maintenance person to replace or maintain the power supply as well as the elevator drive without entering the shaft. The corresponding work may be done from the landing floor through the open landing door or from the car roof.

Mostly the backup power supply may be built by batteries, e.g. Lead-Batteries or Li-ion batteries. But they may be formed also from supercapacitors or other energy storages. Hereinafter when referring to "battery" any kind of backup power supply is included.

Preferably, the elevator drive comprises a frequency converter with a rectifier bridge, an inverter bridge and a DC link in between. This forms is a reliable standard configuration for an elevator drive. In this case, the battery is preferably connected to the DC link as this enables the energization of the elevator brakes as well as the operation of the elevator motor via the emergency drive module. This further has the advantage that the drive is able to provide battery energy to loads that are needed to provide power with minimum amount of current drawn from the backup power supply because the DC link is also assisting as a source of energy for the backup power supply and the loads, when elevator car is driven power generating direction (light direction). This again reduces the battery energy required by the battery operation, which again reduces the battery capacity and accordingly the physical battery size. Thus by this technology an elevator drive with emergency drive ability is created that uses a physically small sized battery compared to elevator drive size. This goal of reduced battery size may further preferably achieved by using lithium Ion or other type of lithium based chemistry batteries which are providing high energy density.

When the inventive drive with an emergency drive module is used, the backup power supply is preferably configured to utilize the available regenerative energy fed from the elevator motor to the DC link and when all loads are connected with the DC link of the drive to be fed from the DC link the required energy is significantly reduced (roughly from range of 4 kW peak power to 1 kW peak power). This allows a small but per se more expensive lithium battery integrated to the drive housing becoming a cheaper solution than a higher energy external lead acid battery—which is per se cheaper—with an external enclosure and interface.

In an earlier solution the three-phase input of the drive was used to supply electricity to every component in the elevator system (excluding doors). When the backup module is connected to the DC link, the controller of the drive can control which components are going to be supplied with power. Hence, the power can be significantly reduced. In both cases, the elevator can use regenerative power. The difference is whether all the components are supplied with power or just the specific ones required for emergency operation.

As the backup module and/or the drive are located in a closed housing and the backup module may be changed without opening of any housing no special precautions are mandatory to avoid touching the high voltage DC link circuit in the drive, while the battery is being replaced.

However, it is highly recommended to open the main switch to before battery replacement. The battery module is located preferably inside a plastic housing with electrically insulation on its outer surface. Thus, battery + and − connections that are during operation in connection with the DC link potential are protected by the surrounding backup module plastic housing from creating any conductive, which is touched by the service person performing the battery replacement. Anyway, a main switch contactor may be preferably located at the mechanical interface between backup module and drive housing to automatically interrupt main voltage when the backup module is detached from the elevator drive.

The backup module has preferably an electric interface permanently fixed to the backup module housing that is connecting the battery to the DC link potential. The drive housing has as a complementary interface fixed into the accommodation area of the drive housing for the backup module. The backup module is then connected preferably by a snap-lock connection to the drive housing.

Preferably the backup module includes the necessary battery management hardware and the electric contacts of the electric interface. By this means, all the essential battery related hardware is located in the backup module. Preferably, in this case the drive only comprises a charging circuit to keep the battery at optimum load level.

The invention provides the following advantages related to non-integrated battery back-up device:

- Additional cost of a separate housing for the battery is avoided.
- Less mechanical parts.
- The need for additional fuses or switches to separate the battery from the drive for time of replacement or maintenance is avoided.
- No space has to be provided for the battery housing in close proximity to the elevator drive.
- Due to the concept of the inventive plug off/plug on battery the replacement activity is easier and faster which reduces the required maintenance time on site.
- Frees space in shaft for other elevator parts.

Also, if the battery is electrically connected to the DC link there are following additional advantages:

- Additional cost of wiring between external battery housings and elevator drive is avoided mostly because there is no wiring which has to be well protected to avoid electric shock of the person touching the wires.
- Due to this direct connection between battery and DC link electromagnetic interference problems like radiated emissions associated with long battery wires are avoided.
- Shorted cables can be used between any battery drive converter circuit that converts the battery voltage to the DC link voltage, which reduces the risk of oscillations that are bound to cause stability issues in converter operation.
- Lifetime benefit
- Lead acid batteries which require frequent replacement may be avoided.
- With lithium batteries the expected lifetime can increase up to ten years and reduce significantly the service cost and required amount of site visits due to problems in high ambient temperature elevators where replacement is even more frequent than the standard replacement period.
- Lead is a hazardous substance and replacing it with lithium batteries is an ecological solution.

Following terms are used as synonym: battery—backup power supply—super capacitor; backup module housing—module housing;

It shall be clear for the skilled person that the above-mentioned embodiments may be combined with each other arbitrarily.

The invention is now described via an example in connection with the enclosed drawings.

Figure 2:
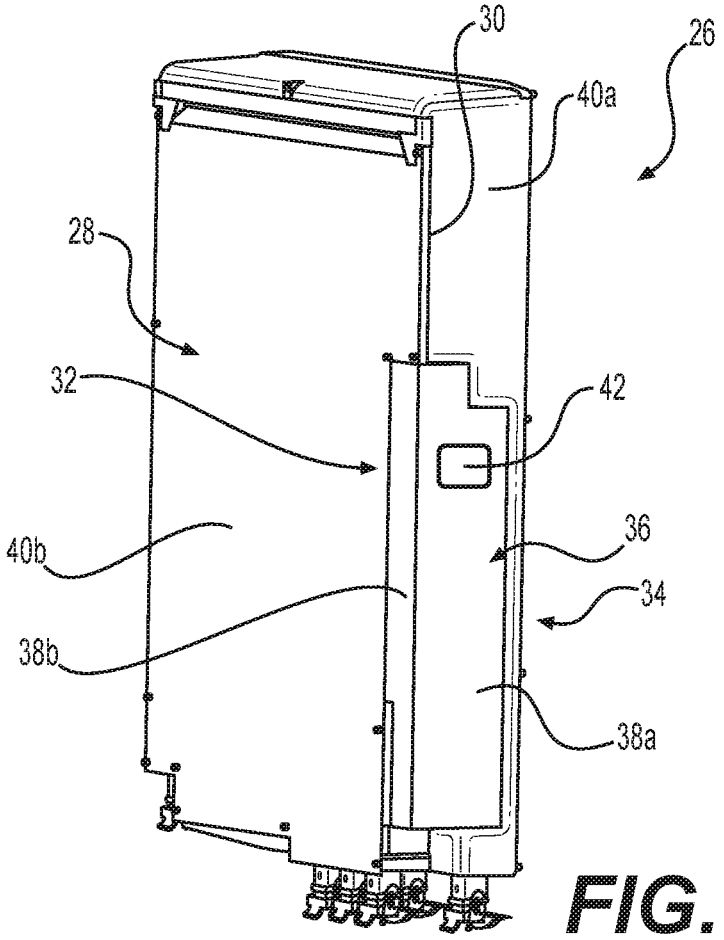
Figure 3:
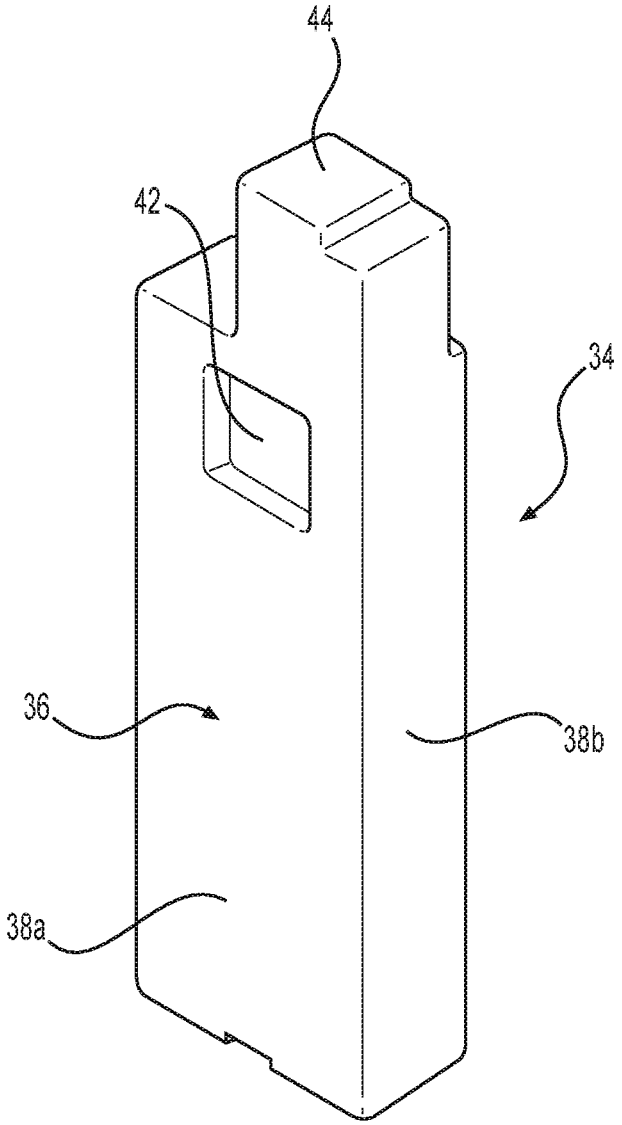

FIG. 1 shows a perspective view of a part of an elevator in the upper end of an elevator shaft, FIG. 2 an elevator drive including an elevator drive housing with an integrated detachable backup module, FIG. 3 a perspective view of the backup module.

FIG. 1 shows an elevator 10 in the upper part of an elevator shaft 12 having landing doors 14. The figure shows the upper part of a car guide rail 16 for an elevator car and two counterweight guide rails 18*a*, 18*b* for a counterweight. At the upper end of the car guide rail 16 an elevator motor 20 is mounted comprising two elevator brakes 22*a*, 22*b*. The elevator brakes 22*a*, 22*b* are acting on brake faces of a traction sheave 24 which is connected to the rotor of the elevator motor 20. The elevator motor 20 is operated via an elevator drive 26 located above the landing door 14 so that it can be reached by a maintenance person from the landing door or standing on top of the elevator car.

The elevator drive 26 preferably comprises a per se known frequency converter with a DC link between a rectifier bridge and an inverter bridge. The elevator drive 26 is located in an electrically isolated cubic drive housing 28 made of plastics which is shown in more detail in FIG. 2. Preferably, the elevator drive 26 comprises an emergency drive module to enable the release of trapped passengers in case of a power fault of the mains AC network. In the area of one edge 30 of the drive housing 28 an accommodation recess 32 is provided in which a backup module 34 is releasably mounted, preferably plugged, whereby the mounting position as shown in FIG. 2 is secured preferably with a snap-lock connection. The backup module 34 has a backup module housing 36 which is preferably made of plastics like the drive housing 28 and thus protects the enclosed electric components against access and dirt. The backup module has two outer surfaces 38*a*, 38*b* which are aligned with corresponding outer surfaces 40*a*, 40*b* of the drive housing 28. Via this measure, there are no edges or corners of the backup module housing 36 protruding from the corresponding outer surfaces 40*a*, 40*b* of the drive housing 28. Thus, the complete arrangement is less susceptible for dirt and mechanical damage.

The elevator drive combined with the emergency drive module and an optional backup power supply charging circuit requires a minimum amount of additional electronics. Therefore, the entire drive system 26 with all battery related hardware is fitting into the drive housing 28 and does not need additional room or additional wiring in the elevator shaft 12.

The backup module 34 comprises preferably a release button 42 with which the snap-lock connection of the backup module 34 to the drive housing 28 can be released. Thus, the backup module can easily be detached, e.g. for maintenance or replacement.

FIG. 3 shows a perspective view of the backup module 34 with its backup module housing 36. The backup module 34 has at one end side an electric interface 44 which automatically connects with a complementary electric interface in the drive housing 28 so that an automatic electric connection of the backup module 34 with the elevator drive 26 takes place when the backup module 34 is plugged into its mounting position in the drive housing 28. The linear movement of the plugging may be guided by guide components which are not shown in the figure.

Furthermore, the electric interface as well as the complementary interface may preferably comprise a movable isolation which prevents an access to the electric contacts thereof when the backup module 34 is unplugged.

The elevator drive 26 may also comprise the brake controller for both elevator brakes 22*a*, 22*b*.

The invention is not restricted to the disclosed embodiment but may be varied within the scope of the attached patent claims.

LIST OF REFERENCE NUMBER

10 elevator
12 elevator shaft
14 landing door
16 car guide rail
18*a,b* counterweight guide rails
20 elevator motor
22*a,b* elevator brakes
24 traction sheave
26 elevator drive
28 drive housing
30 edge with the accommodation recess for the backup module
32 accommodation recess for the backup module
34 backup module
36 backup module housing
38*a,b* outer surfaces of the backup module housing
40*a,b* outer surfaces of the drive housing
42 release button of the snap-lock connection
44 electric interface of the backup module

The invention claimed is:

1. An elevator comprising:
an elevator motor; and
an elevator drive including,
a drive housing including a recess therein, and
a backup module housing selectively secured within the recess in the drive housing, the backup module housing including a backup module, the backup module including,
a backup power supply,
an emergency drive module configured to enable release of trapped passengers in case of a power fault based on energy stored in the backup power supply, and
a backup module electric interface configured to detachably connect to an elevator drive electronic interface of the elevator drive located at the drive housing.

2. The elevator according to claim 1, wherein one or more of the backup module housing or drive housing is a plastic housing or an insulated aluminium housing.

3. The elevator according to claim 1, wherein the backup module is selectively releasable from the drive housing.

4. The elevator according to claim 1, wherein the recess is in an edge of the drive housing.

5. The elevator according to claim 4, wherein outer surfaces of the backup module housing are aligned with corresponding outer surfaces of the drive housing, when the backup module housing is mounted to the drive housing.

6. The elevator according to claim 1, wherein the backup module housing is fixed to the drive housing via a snap-lock connection.

7. The elevator according to claim 1, wherein the backup module electrical interface and the elevator drive electronic interface are located at areas of the backup module housing and the drive housing, respectively, which do not form outer surfaces after the backup module is mounted to the drive housing.

8. The elevator according to claim 1, wherein
the backup module electrical interface is selectively covered by a first movable isolation, and the elevator drive electronic interface is selectively covered by a second movable isolation.

9. The elevator according to claim 8, wherein the first movable isolation is movable in response to pressure applied thereto from the elevator drive electrical interface, and the second movable isolation is movable in response to pressure applied thereto from the backup module electrical interface.

10. The elevator according to claim 1, wherein the elevator drive comprises:

a charging circuit configured to recharge the backup power supply.

11. The elevator according to claim 1, wherein the backup power supply comprises:

a battery and/or a supercapacitor.

12. The elevator according to claim 1, wherein the drive housing and the backup module housing comprise complementary guides which are configured to define a linear movement of the backup module housing with respect to the drive housing such that the linear movement is limited by stop faces, which enable a reliable connection of the backup module electric interface with the elevator drive electric interface.

13. The elevator according to claim 1, wherein the drive housing is installed in an elevator shaft in the vicinity of an elevator landing door or access opening.

14. The elevator according to claim 1, wherein the elevator drive further comprises:

a frequency converter with a rectifier bridge, an inverter bridge, and a DC link in between the rectifier bridge and the inverter bridge, and wherein the backup power supply is connected to the DC link of the elevator drive.

15. The elevator according to claim 1, wherein a main switch contactor is located at an interface between the backup module housing and drive housing to automatically interrupt main voltage when the backup module is detached from the elevator drive.

16. The elevator according to claim 11, wherein the drive housing and the backup module housing comprise complementary guides which are configured to define a linear movement of the backup module housing with respect to the drive housing.

17. An elevator drive, comprising:

a drive housing including a recess therein; and a backup module housing selectively secured within the recess in the drive housing, the backup module housing including a backup module, the backup module including, a backup power supply, an emergency drive module configured to enable release of trapped passengers in case of a power fault based on energy stored in the backup power supply, and a backup module electric interface configured to detachably connect to an elevator drive electronic interface of the elevator drive located at the drive housing.

18. The elevator drive according to claim 17, wherein the drive housing and the backup module housing comprise complementary guides which are configured to define a linear movement of the backup module housing with respect to the drive housing.

* * * * *